United States Patent [19]

Takeda et al.

[11] Patent Number: 4,615,915

[45] Date of Patent: Oct. 7, 1986

[54] METHOD FOR FORMING THICK COATED FILM ON THE WELDED JOINT PART OF WELDED METALLIC CAN

[75] Inventors: Susumu Takeda, Urawa; Shigeru Kobayashi, Tokyo; Kenji Kunimitsu, Urawa, all of Japan

[73] Assignee: Dainippon Ink and Chemicals, Inc., Tokyo, Japan

[21] Appl. No.: 716,696

[22] Filed: Mar. 27, 1985

[30] Foreign Application Priority Data

Mar. 27, 1984 [JP] Japan ..... 59-57,277

[51] Int. Cl.[4] ..... B05D 7/22; B05D 3/02

[52] U.S. Cl. ..... 427/239; 427/379

[58] Field of Search ..... 427/239, 379

[56] References Cited

U.S. PATENT DOCUMENTS 4,382,525 5/1983 Kobayashi et al. ..... 428/35 X

*Primary Examiner*—James R. Hoffman

*Attorney, Agent, or Firm*—Sherman and Shalloway

[57] ABSTRACT

A thick resin film is formed on the joint part of a welded metallic can body by first coating the joint part with a primer composed of a solution of a thermosetting resin in an organic solvent and drying it, and then coating the dried primer layer with a slurry paint composed of a dispersion of a thermoplastic resin powder in a poor solvent, and drying the coating. The resin powder has a specific gravity differing from that of the poor solvent by not more than 0.2.

13 Claims, 6 Drawing Figures

COMPRESSION AIR SUPPLY
2
MOISTURE AND OIL REMOVING DEVICE
3
P
4
TANK
1
HEATER
5
FILTER
6
REGULATOR
7
CIRCULATION VALVE
12
15
11
10d
16
8
10d
10c
10b
10a
9

METHOD FOR FORMING THICK COATED FILM ON THE WELDED JOINT PART OF WELDED METALLIC CAN

This invention relates to a method for forming a thick coated film on the welded joint part of a welded metallic can.

Welded metallic cans produced from tin plates, nickel steel plates or tin-free steel plates are widely used for holding liquids such as carbonated beverages. Such a welded can is produced, as shown in FIG. 1 of the accompanying drawings, by folding a blank such as a tin plate, nickel steel plate or tin-free steel plate so that its marginal zones overlap, seam-welding the overlapping part to make a can body, and securing end plates (not shown) to both ends of the can body. To prevent corrosion by articles filled in cans, the blank is coated at its inside surface with a varnish a leaving only the marginal zones to be welded as shown in FIGS. 1 and 2 of the accompanying drawings. The uncoated marginal zones are caused to overlap and welded, and after welding, the welded part is coated with a slurry paint b as shown in FIG. 2 to prevent corrosion. Since a stepped portion d having the end surface of the blank and a protrusion e having an edge c generated upon removing of the electrode exist in the welded part, such portions should naturally be coated. The protrusion e sometimes amounts to 20 to 30 microns in height, and to cover it, a thick coating is applied. Hence, a paint for this purpose is preferably one having a high resin content. However, when a thermosetting resin paint, for example, is used and applied to a thickness of at least 15 microns, the applied coating vigorously foams upon rapid heating described hereinbelow, and a smooth coated film cannot be obtained. Furthemore, since the thixotropy of this paint is low, covering of the stepped portion d, the protrusion e and the edge c (edge covering property) is not good. An attempt has been made to remedy this defect by electrostatically coating a powder paint composed of a thermoplastic resin, such as a polyamide resin, which melts when heated and forms a film when cooled. The powder paint, however, does not easily adhere to the stepped portion d, and the resin powder scatters during coating to pollute the air. Furthermore, it adheres not only to the required surface of the can body, but also to the unwanted parts near it. In an attempt to avoid these inconveniences, a recovering device for recovering the powder by sucking as described in Japanese Patent Publication No. 4428/1973, or an air-scraper is used so as to coat the powder only on the required surface. Such a powder recovering device is also described in Japanese Laid-Open Patent Publication No. 167761/1982 which discloses the additional use of a skirt adapted to prevent scattering of the powder to unwanted areas. However, the aforesaid recovering device, scraper and skirt are costly, and the use of these means cannot satisfactorily circumvent the adhesion of the powder paint to the unwanted areas. A hygienic problem arises if a can is made while the paint powder remains adhering to unwanted areas of the inside surface of the can body, and an article is filled in it.

The aforesaid problem can be avoided if a slurry paint containing a polyamide resin is used. However, even when a slurry paint obtained by dispersing the polyamide resin in a solvent is applied directly to the joint part of a can, the coated film does not at all adhere to the joint part.

It is the practice therefore to coat a slurry paint prepared by dispersing a polyamide resin in a thermosetting resin solution by a coating device of the type shown in FIG. 3 of the accompanying drawings. Specifically, the paint stored in a tank 1 is sent to a regulator 7 via a heater 5 and a filter 6 by means of a pump 4 actuated by air delivered from a compression air supply 2 via a moisture and oil removing device 3. The amount of coating of the paint is regulated by the regulator 7, and the paint is jetted from a nozzle 8 terminating in an opening portion (window) 91 of a pipe 9. In the meantime, a metallic blank 10*a* is bent along the hollow pipe 9 to form a bent blank 10*b* and further bent to form a bent blank 10*c*. The marginal zones of the bent blank 10*c* are caused to overlap and welded to form a can body 10*d*. The details of the can body 10*d* are shown in FIG. 1. The welded part of the can body 10*d* is successively moved over the opening portion of the pipe 9 and coated in a line with the paint jetted out as described above. As a result, a slurry paint film b as shown in FIG. 2 is formed. The outside of the welded part is coated by another method. Thereafter, the can body 10-*d* is heated by a heating device 15 such as a direct gas flame, infrared ray or high-frequency waves while being conveyed by a conveyor 11. The reference numeral 12 is a circulation valve for returning the paint to the tank 1 when the piant is not coated on the welded part from the nozzle 8.

Since the above slurry paint contains the polyamide resin dispersed in high concentrations, the stability of the slurry is poor. Furthermore, since it is conveyed under pressure through a narrow pipe and jetted out from the nozzle 8, the resin powder precipitates on, and blocks up, narrow flow passages such as corners of the joint of pipes of different diameters, an electromagnetic valve used as the circulation valve and the nozzle, and the filter, and the operation cannot be performed continuously. When the slurry has poor stability and the operation fails to be performed smoothly, the thickness of the coated film applied varies and a uniform coated film cannot be obtained (for example, the film thickness may vary over a wide range of 40 to 200 microns). To avoid these troubles, the proportion of the thermoplastic resin solution should be increased. This, however, results in a relative increase in the proportion of the liquid paint. Hence, a thick film cannot be obtained, and bubble formation increases during the heating of the coated film. In particular, since cans for holding foods are produced on automated assembly-lines and undergo heating to about 250° C. from room temperature at a high speed within 5 to 60 seconds, foaming readily occurs in the coated film. If the dry coated film of the thermosetting resin solution has a thickness of 15 microns or more, foaming causes an uneven surface, and a uniform and flat coated film cannot be obtained.

As stated above, conventional solvent-based paints have poor edge covering property and cannot provide thick coated films. Conventional powder paints require an additional cost for recovering the powder that has scattered, and also have problems in regard to the adhesion of the powder to unwanted areas and the adhesion of the powder to the desired metal surface. Furthermore, conventional slurry paints such as one obtained by dispersing a thermoplastic resin such as a polyamide resin in a thermosetting resin solution have the effect that the resin particles deposit in narrow flow passages to block them up and lead to the lack of operational stability and to the inability to give a uniform coated film.

It is an object of this invention to provide a method by which a thick coated film can be formed on the welded joint part of a welded metallic can by solving the aforesaid problems of the prior art.

Figure 1:
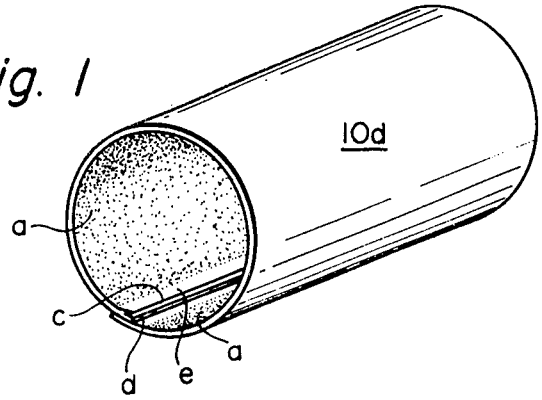
FIG. 1 is a schematic view, in elevation, of a side seam welded can body, without end plates.
Figure 2:
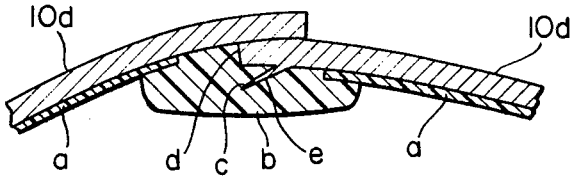
FIG. 2 is a cross-section view of the side seam welded portion of the can body of FIG. 1 showing a conventional slurry paint coating of the welded portion.

This object is achieved in accordance with this invention by a method which comprises a first step of coating the welded joint part of a welded metallic can with a primer composed of a solution of a thermosetting resin in an organic solvent and drying it, and a second step of coating the dried primer layer with a slurry paint composed of a dispersion of a thermoplastic resin powder in a poor solvent, said resin powder having a specific gravity differing from that of the poor solvent by not more than 0.2, and drying the coating.

Examples of the primer paint used in this invention include various paints of the epoxy-amino resin, epoxy-phenol resin, epoxy ester-amino resin, polyester-amino resin, alkyd-amino resin, acrylic-amino resin, self-curable acrylic resin, and urethane resin types. When a polyamide resin is used as a resin powder for the slurry paint, an epoxy-phenol resin type paint proves excellent as the primer paint in respect of adhesion. The epoxy resin is preferably a bisphenol A-type epoxy resin having a number average molecular weight of 800 to 5000. Examples of the amino resin are resins obtained by reacting triazine compounds such as melamine, urea and benzoguanamine with formaldehyde, and modified products thereof obtained by etherifying these resins with lower alcohols. The phenolic resin may be a resol-type phenolic resin obtained by reacting a phenol with formaldehyde in the presence of an alkaline catalyst. The suitable ratio of the epoxy resin to the amino resin or the phenolic resin is from 95:5 to 50:50. For acceleration of curing, an acid substance such as phosphoric acid, phosphoric acid esters, and p-toluenesulfonic acid or an organic metal compound such as aluminum alcoholates or alkyl titanates may be added.

Examples of the thermoplastic resin powder used to prepare the slurry paint include polyamide resins, an ethylene/vinyl acetate copolymer resin, polyolefin resins, polyester resins, a polyacetal resin, acrylic resins, ABS resin, a styrene-acrylonitrile copolymer resin, and mixtures of these. The thermoplastic resin powder suitably has an average particle diameter of 10 to 70 microns, preferably 10 to 30 microns. As required, this resin powder may include various auxiliary agents such as pigments (extender pigments or colored pigments), lubricants, and plasticizers.

The solvent used to prepare the slurry paint is a poor solvent which does not dissolve the powder contained in the paint and has a specific gravity differing from that of the powder by not more than 0.2. Such a solvent can be prepared by mixing a general solvent for paints such as an aromatic hydrocarbon, an aliphatic hydrocarbon, an ester, a ketone, an alcohol or an ether with a suitable amount of a halogenated hydrocarbon. Examples of the halogenated hydrocarbon include chlorinated hydrocarbons such as 1,1,1-trichloroethylene, ethylene tetrachloride and carbon tetrachloride, and fluorinated hydrocarbons commercially available from Mitsui Du Pont Fluorochemical, Co., Ltd. under the trademarks "FREON 11", "FREON 112" and "FREON 111".

The use of the above slurry paint can prevent deposition of the resin powder in a paint circulating path being under dynamic conditions and of the consequent blocking of the path to such an extent that such powder deposition does not substantially cause troubles in actual practice. Sometimes, however, such powder deposition in the paint circulating path and its blockage cannot be prevented despite the use of the aforesaid slurry paint when, for example, the inside diameter of the paint circulating path is too narrow or the pressure loss is large because of the existence of many parts of different diameters in joining parts of the pump, regulator, filter, spray gun, return pipe, spray nozzle, etc. This situation can be avoided by using a slurry paint prepared by dissolving a resin soluble in the poor solvent to the slurry paint in an amount of not more than 5 parts by weight, preferably not more than 1 part by weight, per 100 parts by weight of the thermoplastic resin powder in the slurry paint. If the amount of the resin soluble in the poor solvent exceeds 5 parts, foaming occurs in the coated film when it is dried and cured by rapid heating. The resin soluble in the poor solvent which is added to improve the dynamic stability of the slurry paint may be a thermosetting or thermoplastic resin which dissolves in the poor solvent of the slurry paint and does not adversely affect the chemical resistance, heat resistance, etc. of the coated film after film formation. Most suitable resins that can be used for this purpose include, for example, phenolic resins, petroleum resins, and rosin-modified maleic acid resins.

Figure 5:
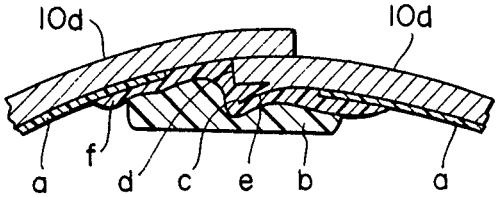
FIG. 5 is a cross-section view of the side seam welded portion and can body according to the present invention.
Figure 4:
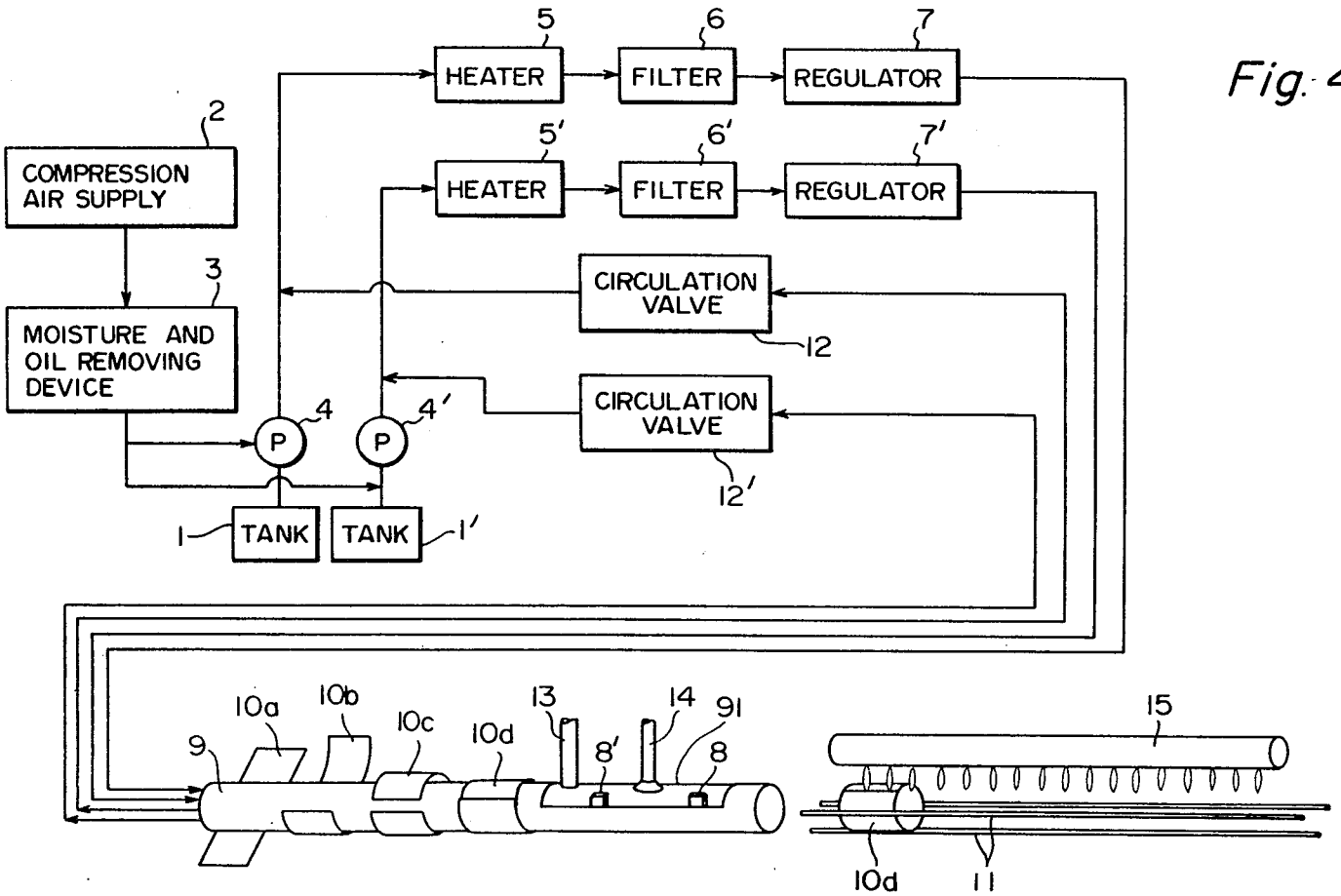
FIG. 4 is a flow chart and schematic view of the coating device and can body forming equipment used in carrying out the method of the present invention.

The device shown in FIG. 4 of the accompanying drawings is one example of practicing the method of this invention. A primer paint stored in a tank 1' is sent to a regulator 7' via a heater 5' and a filter 6' by a pump 4' actuated by air delivered from a compression air supply 2 via a moisture and oil removing device 3. Its amount of coating is regulated by the regulator 7', and the primer paint is jetted out from a nozzle 8' terminating in an opening portion (window) 91 of a pipe 9. The slurry paint stored in the tank 1 is likewise sent to a regulator 7 via a heater 5 and a filter 6 by means of a pump 4. The amount of its coating is regulated by the regulator 7, and it is jetted out from a nozzle 8 terminating in the opening portion 91 of the pipe 9 and located ahead of the nozzle 8'. In the meantime, a metal blank **10*a* is bent along the pipe 9 while being conveyed by a conveyor (not shown) to form a bent blank 10*b*. It is further bent to form a bent blank 10*c*. The marginal zones of the bent blank 10*c*** are then caused to overlap each other and welded by a welding device (not shown)

to form a can body 10*d* of the type shown in Fig. 1. Cool air is blown against the welded joint part of the can body 10*d* from a high-pressure air nozzle 13 to cool it to a temperature at which the primer paint does not bump. The primer paint is impinged against the welded joint part from the nozzle 8' and then set by hot air from a hot air nozzle 14. Thereafter, from the nozzle 8, the slurry paint is impinged against the primer layer. While being conveyed by a conveyor 11, the can body 10*d* is heated by a heating device 15 using direct flames (or hot air or high frequency waves) to dry the coated paint. As a result, a primer film f and a slurry paint film b as shown in FIG. 5 are formed. In FIG. 4, the reference numerals 12' and 12 represent circulation valves for returning the primer paint and the slurry paint discharged from the nozzles 8' and 8 to the tanks 1' and 1.

In the first step, the suitable thickness of the primer film is not more than 15 microns, preferably not more than 5 microns. When the coated film of the primer is abruptly heated to a temperature above the boiling point of the solvent contained in the primer paint, foaming tends to occur to a greater extent as the thickness of the coated film is larger. Usually, vigorous foaming or bumping occurs when the thickness of the coated film exceeds 15 microns. Hence, to heat the primer paint rapidly, the thickness of the coated film is preferably not more than 15 microns. As the film thickness is smaller, a smoother dry film free from foaming or bumping can be obtained.

The purpose of applying the primer paint is (1) to impart the adhesion of a molten film of a thermoplastic resin powder to a substrate metal, (2) to cover completely depressions on the stepped portion having the end surface of the blank, and (3) to impart corrosion resistance and sulfide resistance to the substrate metal.

Particularly, in regard to (3), the film thickness should be 3 to 5 microns when an equivalent effect to the varnish applied to the inside surface of a can is expected.

The thick coated film in accordance with this invention is characterized by having a double structure in which the coated film of the slurry paint is laminated to the coated film of the primer paint, and the two coated films are bonded to each other by surface-to-surface contact without being substantially intermingled. When the thermoplastic resin of the slurry paint and the thermosetting resin of the primer paint are not compatible, adverse effects are exerted on the adhesion, workability, corrosion resistance, etc. of the coated film when these resins get mixed with each other. The following means are effective for obtaining a double structure in which the two do not get mixed.

(1) When the slurry paint is to be coated in the second step, the primer paint applied in the first step at least should have already been set. Otherwise, the slurry paint gets mixed with the primer paint, and the aforesaid defects are caused. Setting of the primer paint can effectively be performed by utilizing the heat of welding remaining in the can or by applying air or heat between the first and second step by providing an air sending means or heating means.

(2) Even when the setting of the primer paint in the first step has been completed when the slurry paint is to be applied in the second step, re-dissolving of the primer by the solvent of the slurry paint causes the same defects as stated above. To prevent it effectively, the solvent in the slurry paint should have a composition which does not re-dissolve the set primer or has difficulty re-dissolving it.

(3) If the drying of the primer paint in the first step is effected to an extent that curing occurs without stopping it at the state of setting, the coated film has increased solvent resistance and has resistance to attack by the solvent of the slurry paint. If, therefore, the above facilities still have room, it is effective to perform the curing of the primer paint and thereafter to coat the slurry paint.

The method of this invention can be applied not only to cans made by using tin plates or tin-free steel plates such as cans for holding foods and drinks, but also to cans produced from steel plates such as drums and bales. The invention is also applicable to retortable vacuum cans, pressure cans for holding carbonated beverages, aerosol cans requiring chemical and solvent resistances, 5-gallon cans, etc. which are produced from a thin metallic blank such as a tin plate or tin-free steel plate. In the production of a can body, the marginal zones of the blank are not necessarily caused to overlap, but may sometimes be caused to butt against each other. In any of these cases, the marginal zones are joined by welding, bonding or soldering. The method of this invention can be applied to any of such joints.

The following Examples and Comparative Examples illustrate the present invention more specifcally. All parts in these Examples are by weight.

1. Preparation of Primer Paint (1) Primer paint A

Seven parts of "Epikote 1009" (an epoxy resin made by Shell Chemical Co.) and 3 parts of "PLYOPHEN TD447" (a phenolic resin made by Dainippon Ink and Chemicals, Co., Ltd.) were completely dissolved in a mixture of 36 parts of ethyl acetate, 36 parts of methyl ethyl ketone and 18 parts of isopropyl alcohol. The resulting thermosetting paint is referred to as primer paint A.

(2) Primer paint B

A thermosetting paint was prepared in the same way as in the preparation of the primer paint A except that "PLYOPHEN TD447" was not used. The paint is referred to as primer paint B.

2. Preparation of Slurry Paint (1) Slurry paint A

Twenty-two parts of "Diamide X1891" (nylon 12 powder made by Dai Selu-Huels Co., Ltd.; specific gravity 1.014) was uniformly dispersed in a mixture (specific gravity 1.025) of 39 parts of "ISOPAR G" (isoparaffin made by Esso Chemical Co.) and 39 parts of "FREON 112" (tetrachlorodifluoroethane made by Mitsui Du Pont Fluorochemical, Co., Ltd.). The dispersion is referred to as slurry paint A.

(2) Slurry paint B

Twenty-two parts of "Diamide X1891" (specific gravity 1.014) was uniformly dispersed in a uniform solution (specific gravity 1.015) composed of 23 parts of "ISOPAR G", 47 parts of "FREON 112" and 8 parts of primer A. The dispersion is referred to as slurry paint B.

(3) Slurry paint C

Thirty parts of "VYLON 200" (a polyester resin powder made by Toyobo Ltd.; specific gravity 1.255) was uniformly dispersed in a mixture (specific gravity 1.010) of 34 parts of "ISOPAR G" and 36 parts of "FREON 111". The dispersion is referred to as slurry paint C.

(4) Slurry paint D

Twenty-five parts of "FLO-THENE UF-20" (a polyethylene powder made by Seitetsu Chemical Co., Ltd.; specific gravity 0.920) was uniformly dispersed in a mixture (specific gravity 0.910) of 51 parts of "ISOPAR G" and 24 parts of "FREON 111". The dispersion is referred to as slurry paint D.

(5) Slurry paint E

Twenty parts of "LEVASINT" (an ethylene/vinyl acetate copolymer resin powder made by Bayer AG; specific gravity 0.970) was uniformly dispersed in a mixture (specific gravity 0.820) of 67 parts of "ISOPAR G" and 13 parts of "FREON 112". The dispersion is referred to as slurry paint E.

3. Coating of a Welded Joint Part

The primer paint and the slurry paint were applied to a welded joint part and dried by using the device shown in FIG. 4. A tin plate having a thickness of 0.17 mm and a tin basis weight of 25 lb/B.B. was coated all over with an epoxy-phenol type paint excepting only its marginal portions to be caused to overlap and dried to prepare a body blank for No. 201 cans. The body blank was folded in a cylindrical form with its coated surface directed inwardly. Both marginal zones were caused to overlap, and then welded by a can-making welder in the presence of nitrogen gas to form a welded can body. The can body was fed to the aforesaid coating device. The amount of the primer paint coated was 2 microns as its dry film thickness, and the amount of the slurry paint coated was adjusted to 40 microns as its dry film thickness.

Figure 6:
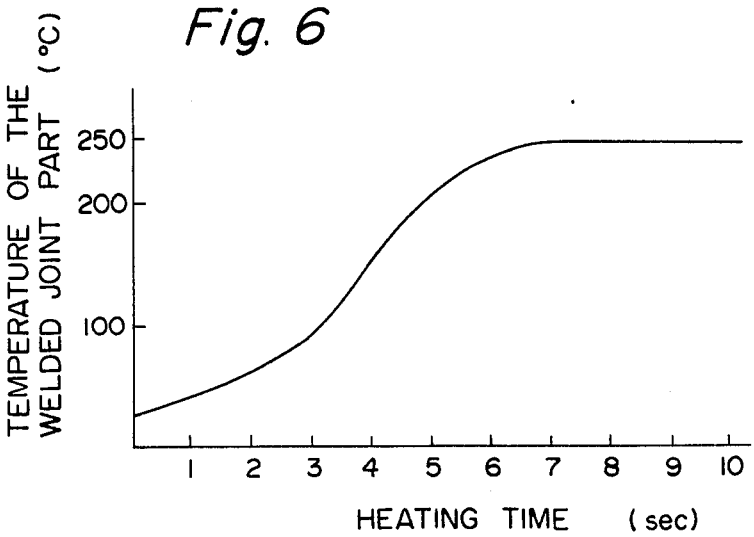
FIG. 6 is a plot of temperature of the welded joint versus heating time during the coating of the welded joint for the specific Examples 1, 2 and 3 and comparative Examples 1 and 2.
Figure 3:
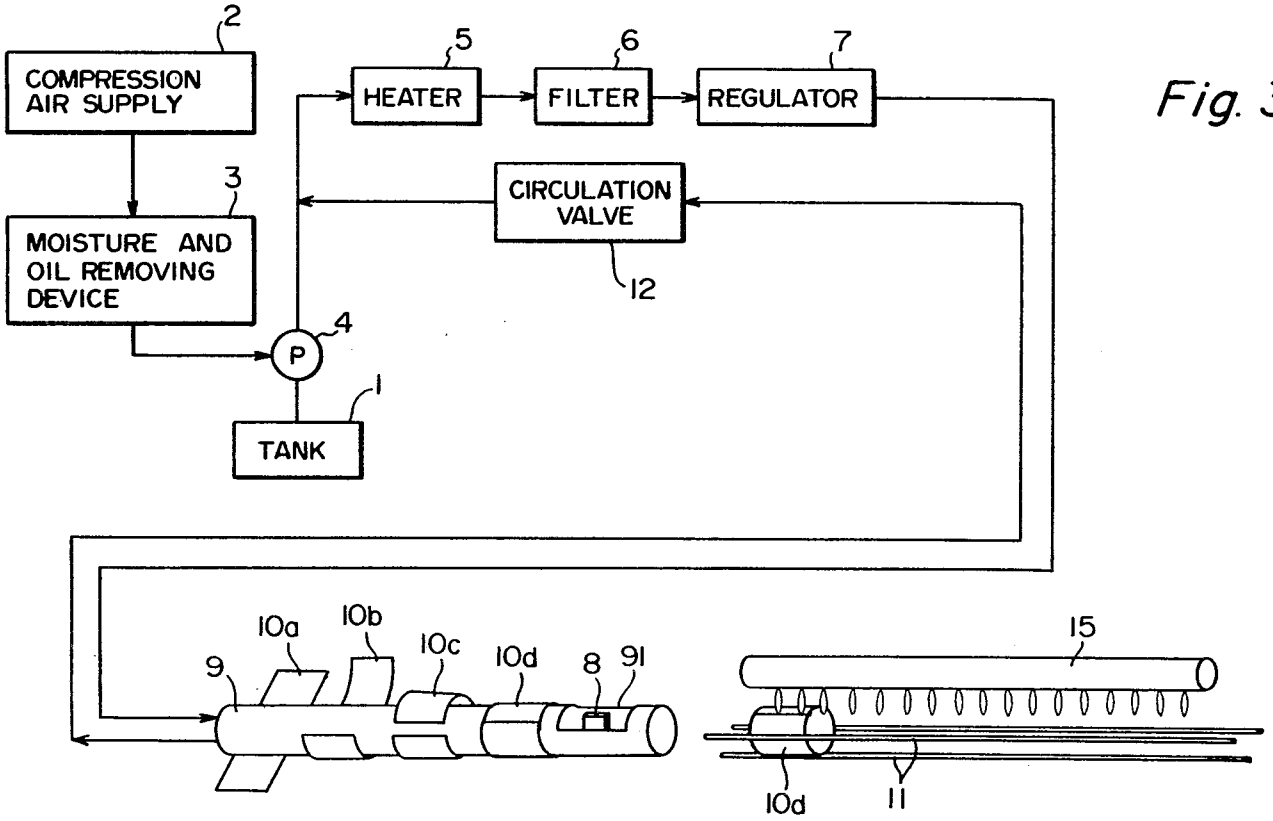
FIG. 3 is a flow chart and schematic view of the coating device and can body forming equipment used to make a welded can body and apply the slurry coating of FIG. 2.

The can body coated with the slurry paint was passed through a drying device in 10 minutes, and at this time, the strength of fire in the drying device was adjusted so that the temperature of the welded part of the can body reached 250° C. in 10 seconds with the temperature curve shown in FIG. 6 of the accompanying drawings.

4. Evaluation of the coated film on the welded joint part

The coated welded can was cut open, and test samples in a rectangular shape with a size of 30 mm×108 mm were taken so that the coated joint part was located centrally in each sample. These samples were tested for the following properties.

(1) Edge covering property

The test sample was immersed for 3 minutes in a test solution prepared by adding 5% of hydrochloric acid to an aqueous solution of copper sulfate, and then the number of dots of copper deposited in the vicinity of the welded joint part was counted by using a magnifying glass. The results were evaluated by O which shows that no copper was deposited, and X which shows that copper dots were observed.

(2) Resistance to working

The X mark was formed by a knife on the coated film at the welded joint part of the test sample. An impact center was applied to the center of the X mark from its back, and an impact of 500 g×50 cm was exerted on the impact center. Thereafter, a peel test was performed on the coated film using a cellophane tape, and cracking and peeling of the coated film were observed. The results are expressed by O which shows that no cracking or peeling of the coated film occurred; Δ which shows that peeling occurred only at the center of the X mark; and X which shows that cracking was observed in the coated film or peeling was observed at parts other than the central part.

(3) Resistance to retorting

The test sample was sterilized by steaming at 125° C. for 30 minutes, and the transparency of the coated film in the vicinity of the welded Joint part was observed. The results were expressed by O which shows that the coated film was not different from that before retorting and remained transparent; Δ which shows that although there is slight whitening, the gloss of the substrate tin plate was observed; and X which shows that whitening was remarkable, and the gloss of the substrate tin plate was not observed.

(4) Resistance to foaming

The coated film was observed, and evaluated by O which shows that the finished coated film was smooth and flat; Δ which shows that raised and depressed portions were observed on the coated film; and X which shows that crater-like foams were observed in the coated film.

(5) Resitance to continuous coating

The jet nozzle 8 of the device shown in FIG. 4 is a crosscut nozzle of Nordson Co. and had a nozzle chip (No. 50352). The inside surface of the welded part was coated continuously by impinging the slurry paint from the above nozzle under a regulator pressure of 24 kg/cm$^2$ and at a discharge rate of 40 g/min. The results were expressed by O which shows that the coating could be performed continuously for at least 4 hours without nozzle blockage, and X which shows that within 4 hours, nozzle blockage occurred.

5. Results

Cans for various uses were tested by the above methods, and the results are shown in the following table.

| Run No. | Example 1 | Comparative Example 1 | Comparative Example 2 | Example 2 | Example 3 |
|---|---|---|---|---|---|
| Use of can (for holding) | Coffee | Coffee | Aqueous paint | Carbonated drink | Liquid solvent |
| Primer paint used | A | B | A | A | A |
| Slurry paint used | A | B | C | D | E |
| Edge covering property | O | O | O | O | O |
| Resistance to working | O | X | O | O | O |
| Resistance to retorting | O | X | — | — | — |
| Resistance to foamimg | O | X | O | O | O |
| Resistance to continuous coating | O | O | X | O | O |

What is claimed is:

1. A method for forming a thick coated film on the welded joint part of a welded metallic can which comprises a first step of coating the joint part with a primer composed of a solution of a thermosetting resin in an organic solvent and setting it, and a second step of coating the set primer layer with a slurry paint composed of a dispersion of a thermoplastic resin powder in a poor solvent, said resin powder having a specific gravity differing from that of the poor solvent by not more than 0.2, and drying the coating.

2. The method of claim 1 wherein the primer paint is a paint of the epoxy-amino resin, epoxy-phenol resin, epoxy ester-amino resin, polyester-amino resin, alkydamino resin, acrylic-amino resin, self-curable acrylic resin or urethane resin type.

3. The method of claim 2 wherein the primer paint is an epoxy resin-amino resin paint or an epoxy resin-phenolic resin paint in which the ratio of the epoxy resin to the amino resin or the phenolic resin in said primer paint is from 95:5 to 50:50.

4. The method of claim 2 wherein the epoxy resin is a bisphenol A-type epoxy resin having an average molecular weight of 800–5,000.

5. The method of claim 2 wherein the primer paint includes an amino resin which is obtained by the reaction of a triazine compound with formaldehyde, or an etherified product thereof.

6. The method of claim 2 wherein the phenolic resin is a resol-type resin from the reaction of a phenol with formaldehyde in the presence of an alkaline catalyst.

7. The method of claim 1 wherein the thermoplastic resin powder is a powder having an average particle size of 10 to 70 microns of a polyamide resin, an ethylene/vinyl acetate copolymer resin, an olefin resin, a polyester resin, a polyacetal resin, an acrylic resin, an ABS resin or a styrene/acrylonitrile copolymer resin.

8. The method of claim 1 wherein the poor solvent is a mixture composed of an aromatic hydrocarbon, an aliphatic hydrocarbon, an ester, a ketone, an alcohol or an ether with a halogenated hydrocarbon.

9. The method of claim 8, wherein the hologenated hydrocarbon is selected from the group consisting of 1,1,1-trichloroethylene, ethylene tetrachloride, carbon tetrachloride, trichlorofluoromethane, tetrachlorodifluoroethane and pentachloromonofluoroethane.

10. The method of claim 1 wherein the poor solvent contains not more than 5 parts by weight, per 100 parts by weight of the thermoplastic resin powder, of a resin soluble in it.

11. The method of claim 10 wherein the resin soluble in the poor solvent is a phenolic resin, a petroleum resin or a rosin-modified maleic acid resin.

12. The method of claim 1 wherein said primer layer has a thickness of not more than 15 microns.

13. The method of claim 1 wherein the coated film of the slurry paint is laminated to the coated film of the primer paint, the two films being bonded to each other by surface-to-surface contact without substantial intermingling.

* * * * *